US005611736A

United States Patent [19]

Anglea

[11] Patent Number: 5,611,736

[45] Date of Patent: Mar. 18, 1997

[54] APPARATUS AND DEVICE USED IN MARKING A BATTER'S BOX

[75] Inventor: James H. Anglea, Arlington, Tex.

[73] Assignee: Anglea Turf Concepts, Inc., Arlington, Tex.

[21] Appl. No.: 479,005

[22] Filed: Jun. 7, 1995

[51] Int. Cl.[6] ..... A63D 5/04

[52] U.S. Cl. ..... 473/415

[58] Field of Search ..... 273/188 A, 186 C, 273/187 A, 187.1, 195 B, 26 R, 410

[56] References Cited

U.S. PATENT DOCUMENTS

| | | | |
|---|---|---|---|
| 2,827,297 | 3/1958 | Foster | 273/410 |
| 5,013,044 | 5/1991 | Hesselbart | 273/186.1 |
| 5,139,263 | 8/1992 | Feo | 273/186.1 |
| 5,255,921 | 10/1993 | Spence | 273/187 A |

*Primary Examiner*—V. Millin
*Assistant Examiner*—Charles Anderson
*Attorney, Agent, or Firm*—Harry C. Post, III

[57] ABSTRACT

A collapsible device used in marking the batter's box on a playing surface of a baseball field. The device uses a first frame half and a second frame half. Each frame half has an elongated side with first and second ends. A first arm with an inwardly disposed end is pivotally connected to the first end of the elongated side and an outwardly disposable end that is movable between an extended position and a closed position located against the elongated side. A second arm with an inwardly disposed end is pivotally connected to the second end of the elongated side and an outwardly disposable end that is movable between an extended position and a closed position that is located against the elongated side. A first hinge pivotally connects the outwardly disposable end of the first arm of the first frame half to the outwardly disposable end of the first arm of the second frame half. A second hinge pivotally connects the outwardly disposable end of the second arm of the first frame half to the outwardly disposable end of the second arm of the second frame half so that the first and second arms of the first and second frame halves are movable to the closed position. A storage container supports the collapsible device while in the collapsed position.

10 Claims, 2 Drawing Sheets

APPARATUS AND DEVICE USED IN MARKING A BATTER'S BOX

TECHNICAL FIELD

This invention relates to a collapsible device used in marking a batter's box and, more especially, to transportable and storable apparatus having a collapsible device used in marking a batter's box.

BACKGROUND ART

It is well known that a device or template is used to mark the position and size of a batter's box relative to the home plate on a baseball playing field and then a powder is applied to the dirt to provide an edge in which the batter must stay when batting.

Such devices are normally made in rectangular shapes and are of a size that makes them unwieldy and cumbersome. Moreover, such devices are normally made from wood planks, which makes them heavy. Thus, it is exceedingly difficult, if not impossible, for an individual to move such device from a place of storage to the home plate. If several persons are employed to move such device to near the home plate, these persons would wait for long periods before moving the device, which is wasteful.

In certain sports programs, such as intramural leagues and city leagues, it is common for a group of playing fields to be used simultaneously. When only a single device is provided for each group of fields, each field in the group is marked before the game begins and not thereafter. Should the markings be erased during play, an official may have a difficult time in determining whether or not a batter was in the batter's box in conformity with the rules.

Further, these devices are not stored in the off season. When a new season begins, new devices are made. This is wasteful of the time and materials used in constucting the old devices.

Accordingly, it is an object of the present invention to provide a device for marking a batter's box on a playing surface in a baseball field that will allow a single grounds keeper to easily move the device.

Further, it is an object of the present invention to provide a collapsible device that is transportable from field to field to mark the batter's box at each of the fields.

Further, it is an object of the present invention to provide apparatus that stores a device for marking the batter's box on a playing field during the off season.

DISCLOSURE OF THE INVENTION

In accordance with the present invention there is provided a collapsible device used to assist in marking a batter's box near a home plate on a playing surface of a baseball field. The collapsible device comprises first and second frame halves with each frame half including an elongated side with first and second ends. A first arm with an inwardly disposed end is pivotally connected to the first end of the elongated side and with an outwardly disposable end that is movable between an extended position and a closed position that is located against the elongated side. A second arm with an inwardly disposed end is pivotally connected to the second end of the elongated side and with an outwardly disposable end that is movable between an extended position and a closed position that is located against the elongated side. A first hinge pivotally connects the outwardly disposable end of the first arm of the first frame half to the outwardly disposable end of the first arm of the second frame half. A second hinge pivotally connects the outwardly disposable end of the second arm of the first frame half to the outwardly disposable end of the second arm of the second frame half such that the first and second frame halves are movable between a marking and collapsed positions.

Further, in accordance with the present invention there is provided apparatus for marking a batter's box on a playing surface of or carrying for a baseball field. The apparatus comprises a collapsible device used in marking the batter's box. The device includes a frame for providing a template of the batter's box on the playing surface. A hinge allows the frame to be moved between a template position and a collapsed position. A storage device is used for supporting the collapsible device while in the collapsed position.

BRIEF DESCRIPTION OF THE DRAWINGS

Other objects and advantages of the invention will become apparent upon reading the following detailed description and upon reference to the drawings, wherein like reference characters are used throughout to designate like parts.

BEST MODE FOR CARRYING OUT THE INVENTION

Figure 1:
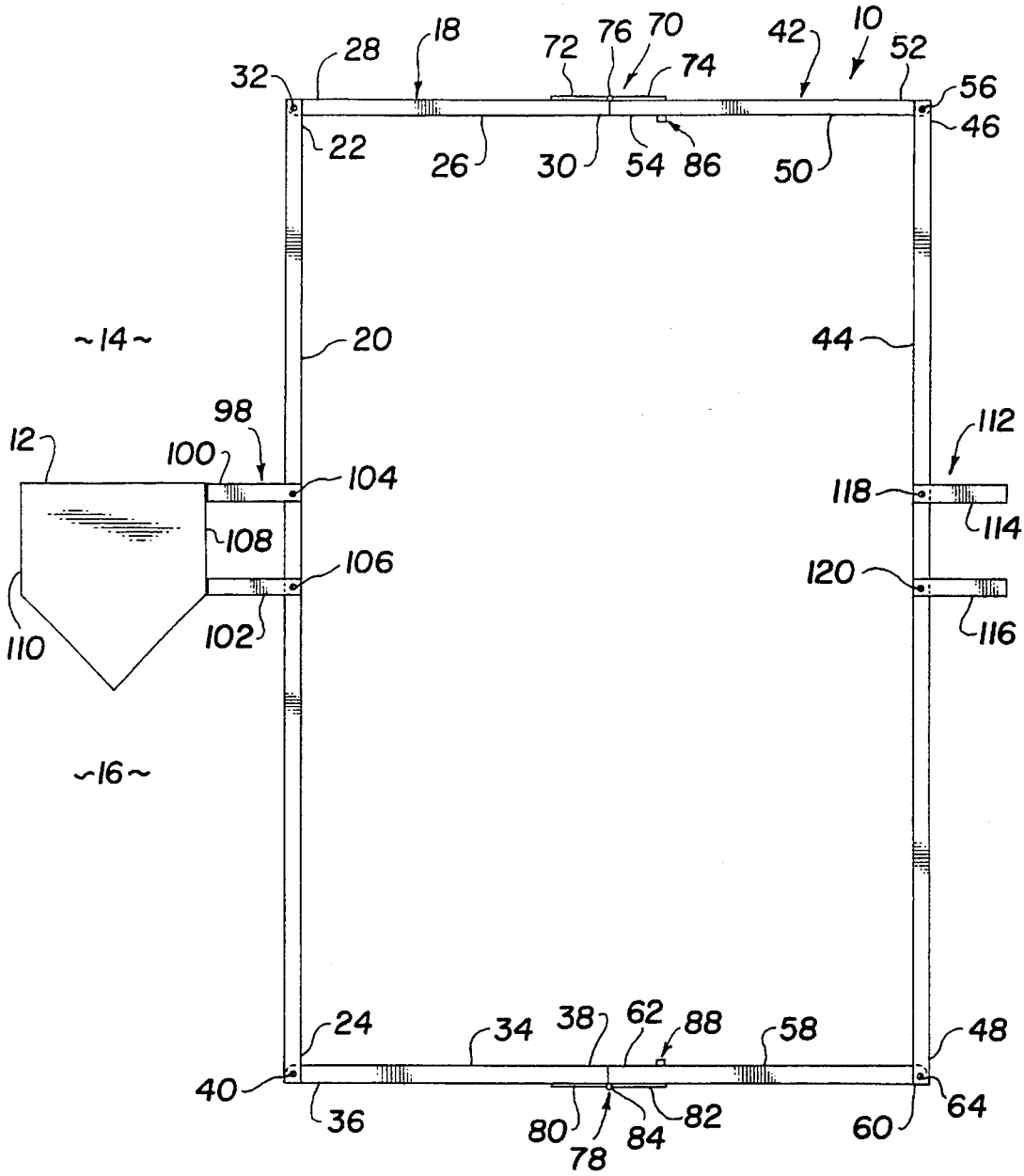
FIG. 1 is a plan view of a device constructed according to the present invention in an open or marking position when being used to mark the batter's box in relation to the home plate.

Now turning to the drawing, there is shown a device 10 constructed according to the present invention. Device 10 is used to assist in marking a batter's box near a home plate 12 on a playing surface 14 of a baseball field 16.

Device 10 has a first frame half 18 with an elongated side 20, which has a first end 22 and a second end 24. Depending on the rules of the game governing the play of baseball, elongated side 20 can vary in size between 66 and 84 inches, and in specific sizes of 66 inches, 72 inches and 84 inches.

Figure 4:
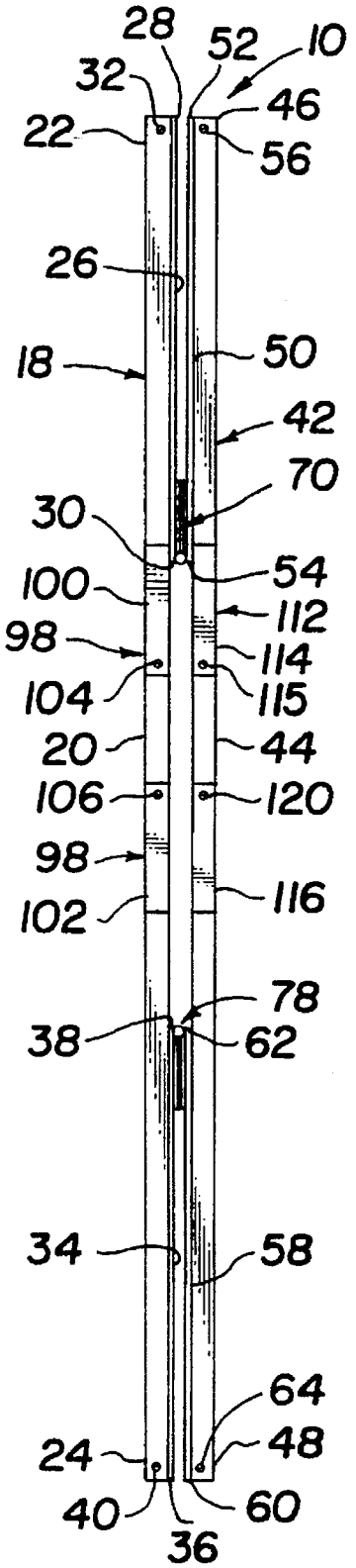
FIG. 4 is an elevation view of the device shown in FIG. 1 in a closed or storing position.
Figure 5:
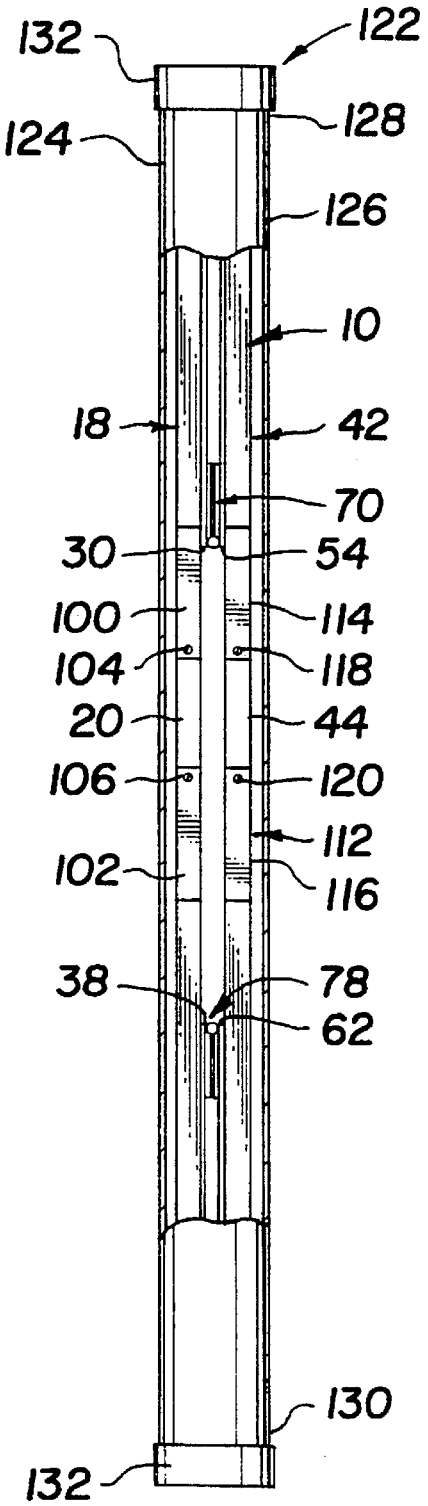
FIG. 5 is an elevation view of the device shown in FIG. 1 in a closed or storing position after being inserted into a carrying case.

A first arm 26 is used in first frame half 18 of device 10 and has an inwardly disposed end 28 and an outwardly disposable end 30. Inwardly disposed end 28 is pivotally connected by pin 32 to first end 22 of elongated side 20. Outwardly disposable end 30 is movable between an extended or marking position, as shown in FIG. 1, and a closed or storing position, as shown in FIGS. 4 and 5, which is located against elongated side 20.

A second arm 34 is used in first frame half 18 of device 10 and has an inwardly disposed end 36 and an outwardly disposable end 38. Inwardly disposed end 36 is pivotally connected by pin 40 to second end 24 of elongated side 20. Outwardly disposable end 38 is movable between an extended or marking position, as shown in FIG. 1, and a closed or storing position, as shown in FIGS. 4 and 5, which is located against elongated side 20.

Device 10 has a second frame half 42 with an elongated side 44, which has a first end 46 and a second end 48. As previously explained in relation to elongated side 20, elongated side 44 can vary in size between 66 and 84 inches, and in specific sizes of 66 inches, 72 inches and 84 inches.

A first arm 50 is used in second frame half 42 of device 10 and has an inwardly disposed end 52 and an outwardly disposable end 54. Inwardly disposed end 52 is pivotally connected by pin 56 to first end 46 of elongated side 44. Outwardly disposable end 54 is movable between an extended or marking position, as shown in FIG. 1, and a closed or storing position, as shown in FIGS. 4 and 5, which is located against elongated side 44.

A second arm 58 is used in second frame half 42 of device 10 and has an inwardly disposed end 60 and an outwardly disposable end 62. Inwardly disposed end 60 is pivotally connected by pin 64 to second end 48 of elongated side 44. Outwardly disposable end 62 is movable between an extended or marking position, as shown in FIG. 1, and a closed or storing position, as shown in FIGS. 4 and 5, which is located against elongated side 44.

To make device 10 sufficiently light so that a single individual can carry it, elongated sides 20 and 44, first arms 26 and 50 and second arms 34 and 58 are preferably made from angle aluminum, which has sides of 1×1 inch and a thickness of ⅛ inch. Device 10 is constructed from the angle aluminum so that a side 66 is disposed to extend parallel to playing surface 14 and facing inwardly above surface 14, as shown in FIGS. 1 and 2, and the remaining side 68 of the angle aluminum is disposed to extend vertically to surface 14.

As best seen in FIGS. 1, a first hinge 70 pivotally connects outwardly disposable end 30 of first arm 26 of first frame half 18 to outwardly disposable end 54 of first arm 50 of second frame half 42. First hinge 70 is of conventional design with a first flange 72 and a second flange 74 connected by a pin 76. Flanges 72 and 74 are connected in a conventional manner to side 68 of the angle aluminum so that disposable ends 30 and 54 are moved against the interior of elongated sides 20 and 44, respectively, as shown in FIGS. 4 and 5.

Figure 2:
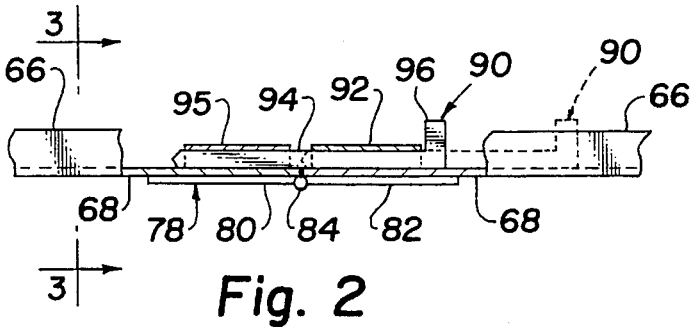
FIG. 2 is an enlarged plan, partly in cross-section, view of a portion of the device shown in FIG. 1.
Figure 3:
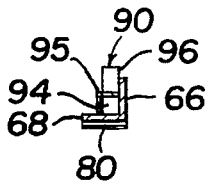
FIG. 3 is a cross-section view taken in the along the lines 3—3 and in the direction of the arrows of the device shown in FIG. 2.

As best seen in FIGS. 1–3, a second hinge 78 pivotally connects outwardly disposable end 38 of second arm 34 of first frame half 18 to outwardly disposable end 62 of second arm 58 of second frame half 42. Second hinge 78 is of conventional design with a first flange 80 and a second flange 82 connected by a pin 84. As with flanges 72 and 74 of first hinge 70, flanges 80 and 82 are connected in a conventional manner to side 68 of the angle aluminum so that disposable ends 38 and 62 are moved against the interior of elongated sides 20 and 44, respectively, as shown in FIGS. 4 and 5.

When device 10 is in the marking position, as shown in FIG. 1, first arms 26 and 50 and second arms 34 and 58 are in an extended position and elongated sides 20 and 44 are disposed from one another by a chosen distance. This distance is chosen to vary from about 36 inches to about 48 inches to comply with the rules governing the play of baseball, and in specific distances of 36 inches and 48 inches.

To prevent first frame half 18 and second frame half 42 from moving relative to one another after arms 26, 34, 50 and 58 have been fully extended, first and second locking apparatus 86 and 88, respectively, are provided to prevent first hinge 70 and second hinge 78 from pivoting.

As best seen in FIGS. 2 and 3, each locking apparatus 86 and 88 includes a plunger or slide member 90 movably connected by a first slide clip or bracket 92 to outwardly disposable end 54 of first arm 50 and outwardly disposable end 62 of second arm 58 of second frame half 42. Plunger member 90 has an elongated body 94 and an upturned shoulder 96 extending from one end of body 94. A second slide clip or bracket 96 is connected to outwardly disposable end 30 of first arm 26 and outwardly disposable end 38 of second arm 34 of first frame half 18. First slide clip 92 and second slide clip 95 extend between sides 66 and 68 of the angle aluminum on the side opposite of from first and second hinges 70 and 78, respectively. By moving plunger member 90 back and forth, elongated body 94 is received and enclosed with slide clips 92 and 95, and flanges 72 and 74 of first hinge 70 and flanges 80 and 82 of second hinge 78 are prevented from rotating around pins 76 and 84.

A first positioning apparatus 98 is connected to the top of side 66 of elongated side 20 of first frame half 18 for positioning first frame half 18 at a chosen distance from home plate 12. The chosen distance from home plate 12 is that distance identified in the rule book governing the play of baseball. First positioning apparatus 98 includes a first elongated member 100 and a second elongated member 102, the elongated members 100 and 102 having a width approximately that of side 66 of angle aluminum. An end of each of elongated member 100 and 102 is pivotally connected by a pin 104 and a pin 106, respectively, to elongated side 20 of first frame half 18. Pins 104 and 106 are disposed away from one another by a distance substantially equal to the length of one of the parallel sides 108 and 110 of home plate 12 so that positioning members 100 and 102 substantially parallel to one another and perpendicular to elongated side 20, elongated side 20 will be substantially parallel to parallel side 108 of home plate 12.

A second positioning apparatus 112 is connected to the top of side 66 of elongated side 44 of second frame half 42 for positioning second frame half 42 at the chosen distance from home plate 12. As previously explained, the chosen distance from home plate 12 is that distance identified in the rule book governing the play of baseball. Second positioning apparatus 112 includes a first elongated member 114 and a second elongated member 116, the elongated members 112 and 114 having a width approximately that of side 66 of angle aluminum. An end of each elongated member 114 and 116 is pivotally connected by a pin 118 and a pin 120, respectively, to elongated side 44 of second frame half 42. Pins 118 and 120 are disposed away from one another by a distance substantially equal to the length of one of the parallel sides 110 of home plate 12. When positioning members 114 and 116 are substantially parallel to one another and perpendicular to elongated side 44, elongated side 44 will be substantially parallel to parallel sides 110 of home plate 12.

Apparatus 122 used in marking batter's box on playing surface 14 of baseball field 16 and storing device 10. Apparatus 122 comprises a collapsible device 10 used in marking the batter's box, which includes a collapsible frame of frame halves 18 and 42 for providing a template of the batter's box on playing surface 14. A hinge is used to move the frame halves 18 and 42 between the template or marking position, as shown in FIG. 1, and a collapsed position, as shown in FIGS. 4 and 5.

A storage container 124 is used to support collapsible device 10 while in the collapsed position. Storage container 124 includes a tubular body 126 having first and second open ends 128 and 130, respectively. Open ends 128 and 130 are sufficient to receive collapsed device 10 into body 126. Body 126 has a length, from end 128 to end 130, sufficient to support elongated sides 20 and 44 of first and second frame halves 18 and 42, respectively, of collapsible device 10. To close open ends 128 and 130, an end cap 132 is provided for each end.

In operation, a grounds keeper picks up container 124 with device 10 inside from a central storage facility and transports it to field 16. After surface 14 has been smoothed, container 124 is taken to near home plate 12, end cap 132 removed from body 126 and device 10 removed from body 126 via open end 128 or 130. First hinge 70 and second hinge 78 are moved away from one another until first arms 26 and 50 and second arms 34 and 58 are fully extended, as shown in FIG. 1. Plunger member 90 of first and second locking apparatus 86 and 88, respectively, is moved into engagement with second slide clip 95. First and second elongate members 100 and 102, respectively, of positioning apparatus 98 are rotated around pins 104 and 106, respectively, until extending substantially transverse to elongated side 20. When the free ends of member 100 and 102 are located directly along side edge 108 of home plate 12, first and second frame halves for a rectangle used in marking the batter's box. A conventional dispenser of chalk compound is moved along the interior shoulder of side 66 of angle aluminum to dispense the markings for the batter's box. After the batter's box on this side of home plate 12 is marked, the other side is marked in a similar fashion except that members 114 and 116 of second positioning apparatus 112 is moved to positions along side 110 of home plate 12 instead of members 100 and 102 being positioned as previously described. After the batter's box has been marked on both sides of home plate 12, plunger member 90 is moved away from clip 95 for locking apparatus 86 and 88. First hinge 70 and second hinge 78 are moved toward one another until in the collapsed position shown in FIG. 4. Device 10 is then moved through open end 128 or 130 into body 126 and end cap 132 attached to the ends of body 126.

The invention having been described, what is claimed is:

1. A collapsible device used in marking a batter's box near a home plate on a playing surface of a baseball field, comprising: first and second frame halves, each frame half including an elongated side with first and second ends, a first arm with an inwardly disposed end pivotally connected to the first end of the elongated side and an outwardly disposable end that is movable between an extended position and a closed position that is located against the elongated side, and a second arm with an inwardly disposed end pivotally connected to the second end of the elongated side and an outwardly disposable end that is movable between an extended position and a closed position that is located against the elongated side; first hinge means for pivotally connecting the outwardly disposable end of the first arm of said first frame half to the outwardly disposable end of the first arm of said second frame half; and second hinge means for pivotally connecting the outwardly disposable end of the second arm of said first frame half to the outwardly disposable end of the second arm of said second frame half such that said first and second frame halves are movable between marking and collapsed positions.

2. A device as set forth in claim 1, further comprising: first positioning means connected to the elongated side of said first frame half for positioning the first frame half at a chosen distance from the home plate.

3. A device as set forth in claim 2, further comprising: said first positioning means including first and second elongated members pivotally connected to the elongated side of said first frame half, the first and second elongated members being pivotally connected to the elongated side of said first frame half and disposed away from one another by a distance substantially equal to the length of one of the parallel sides of the home plate, and each of the first and second elongate members having at a length of at least the chosen distance.

4. A device as set forth in claim 2, further comprising: second positioning means connected to the elongated side of said first frame half for positioning the second frame half at the chosen distance.

5. A device as set forth in claim 4, further comprising: each of said first and second positioning means including first and second elongated members pivotally connected to the elongated side of the respective first and second frame half, the first and second elongated members being pivotally connected to the elongated side of the respective first and second frame half and disposed away from one another by a distance substantially equal to the length of one of the parallel sides of the home plate, and each of the first and second elongate members having a length of at least the chosen distance.

6. A device as set forth in claim 1, further comprising: first locking means for preventing said first hinge means from pivoting when the outwardly disposable ends of the first arms of said first and second frame means are in the extended position.

7. A device as set forth in claim 6, further comprising: second locking means for preventing said second hinge means from pivoting when the outwardly disposable ends of the second arms of said first and second frame means are in the extended position.

8. A device as set forth in claim 7, further comprising: each of said first and second locking means including a plunger movably connected to the outwardly disposable end of the first arm of said second frame half and a bracket connected to the outwardly disposable end of the first arm of said first frame half and disposed to receive the plunger.

9. A device as set forth in claim 1, further comprising: the elongated sides of said first and second frame halves having a length between the first and second ends from about 66 inches to about 84 inches, being disposed from one another when the first and second arms are disposed in the extended positions by a distance of from about 36 inches to about 48 inches.

10. A collapsible device used to assist in marking a batter's box near a home plate on a playing surface of a baseball field, comprising: a first frame half having an elongated side with first and second ends, a first arm with an inwardly disposed end pivotally connected to the first end of the elongated side and an outwardly disposable end that is movable between an extended position and a closed position that is located against the elongated side, and a second arm with an inwardly disposed end pivotally connected to the second end of the elongated side and an outwardly disposable end that is movable between an extended position and a closed position that is located against the elongated side; a second frame half having an elongated side with first and second ends, a first arm with an inwardly disposed end pivotally connected to the first end of the elongated side and an outwardly disposable end that is movable between an extended position and a closed position that is located against the elongated side, and a second arm with an inwardly disposed end pivotally connected to the second end of the elongated side and an outwardly disposable end that is movable between an extended position and a closed position that is located against the elongated side; first hinge means for pivotally connecting the outwardly disposable end of the first arm of said first frame half to the outwardly disposable end of the first arm of said second frame half; second hinge means for pivotally connecting the outwardly disposable end of the second arm of said first frame half to the outwardly disposable end of the second arm of said second frame half such that the first and second arms of said first and second frame halves are movable to the closed position; the elongated sides of said first and second frame halves having a length between the first and second ends from about 66 inches to about 84 inches, being disposed from one another when the first and second arms are disposed in the extended positions by a distance of from about 36 inches to about 48 inches, first locking means for preventing said hinge means from pivoting when the outwardly disposable ends of the first arms of said first and second frame means are in the extended position, said first locking means including a plunger movably connected to the outwardly disposable end of the second arm of said first frame half and a bracket connected to the outwardly disposable end of the first arm of said first frame half and disposed to receive the plunger; second locking means for preventing said hinge means from pivoting when the outwardly disposable ends of the second arms of said first and second frame means are in the extended position, said second locking means including a plunger movably connected to the outwardly disposable end of the first arm of said second frame half and a bracket connected to the outwardly disposable end of the first arm of said first frame half and disposed to receive the plunger; first positioning means connected to the elongated side of said first frame half for positioning the first frame half at a chosen distance from the home plate; second positioning means connected to the elongated side of said first frame half for positioning the second frame half at the chosen distance; each of said first and second positioning means including first and second elongated members pivotally connected to the elongated side of the respective first and second frame half, the first and second elongated members being pivotally connected to the elongated side of the respective first and second frame half and disposed away from one another by a distance substantially equal to the length of one of the parallel sides of the home plate, and each of the first and second elongate members having a length of at least the chosen distance.

* * * * *